US009574405B2

(12) United States Patent
Cariveau et al.

(10) Patent No.: US 9,574,405 B2
(45) Date of Patent: Feb. 21, 2017

(54) HYBRID DISC BIT WITH OPTIMIZED PDC CUTTER PLACEMENT

(75) Inventors: Peter Thomas Cariveau, Spring, TX (US); Prabhakaran K. Centala, The Woodlands, TX (US); Zhehua Zhang, The Woodlands, TX (US)

(73) Assignee: SMITH INTERNATIONAL, INC., Houston, TX (US)

( * ) Notice: Subject to any disclaimer, the term of this patent is extended or adjusted under 35 U.S.C. 154(b) by 1459 days.

(21) Appl. No.: 11/232,434

(22) Filed: Sep. 21, 2005

(65) Prior Publication Data

US 2007/0062736 A1 Mar. 22, 2007

(51) Int. Cl.
*E21B 10/12* (2006.01)
*E21B 10/16* (2006.01)

(52) U.S. Cl.
CPC ..... *E21B 10/12* (2013.01); *E21B 10/16* (2013.01)

(58) Field of Classification Search
CPC ..... E21B 10/12; E21B 10/16
USPC .... 175/334, 351, 365, 373, 374, 349; 703/1; 76/108.1, 108.2, 108.4
See application file for complete search history.

(56) References Cited

U.S. PATENT DOCUMENTS

| | | | | |
|---|---|---|---|---|
| 334,594 | A | 1/1886 | Maloy | |
| 1,026,886 | A | 5/1912 | Thomas | |
| 1,124,241 | A | 1/1915 | Hughes | |
| 1,124,242 | A | 1/1915 | Hughes | |
| 1,124,243 | A | 1/1915 | Hughes | |
| 1,131,701 | A | 3/1915 | Hughes | |
| 1,143,273 | A | 6/1915 | Hughes | |
| 1,143,274 | A | 6/1915 | Hughes | |
| 1,143,275 | A | 6/1915 | Hughes | |
| 1,182,533 | A | 5/1916 | Double | |
| 1,195,208 | A * | 8/1916 | Griffin | 175/354 |
| 1,327,913 | A | 1/1920 | Hughes | |
| 1,348,419 | A | 8/1920 | Hughes | |
| 1,374,867 | A | 4/1921 | Wadsworth | |
| 1,402,684 | A | 1/1922 | Thomas | |
| 1,747,908 | A | 2/1930 | Seifert | |
| 1,812,475 | A | 6/1931 | Gildersleeve et al. | |
| 1,850,358 | A | 3/1932 | Scott | |
| 1,877,225 | A | 9/1932 | Capeliuschnicoff | |
| 1,896,243 | A | 2/1933 | MacDonald | |
| 2,049,543 | A | 8/1936 | Kammerer | |
| 2,121,202 | A * | 6/1938 | Killgore | 175/374 |
| 2,174,587 | A | 10/1939 | Love | |

(Continued)

FOREIGN PATENT DOCUMENTS

| | | | |
|---|---|---|---|
| DE | 19521447 A1 | 12/1996 | |
| GB | 2167107 A * | 5/1986 | E21B 10/46 |

(Continued)

OTHER PUBLICATIONS

"The Disc Bit-A Tool for Hard-Rock Drilling", J.C.R. Placido and J.E. Friant; Dec. 2004 SPE Drilling & Completion; pp. 205-211.

(Continued)

*Primary Examiner* — Kenneth L Thompson

(57) ABSTRACT

The invention provides an improved drill bit and a method for designing thereof. The drill bit includes a bit body, a journal depending from the bit body, and a disc rotatably mounted on the journal. The disc of the drill bit has PDC cutting elements disposed on it. Also provided is an improved cutting structure for the discs of the drill bit. The cutting structure includes a portion that is comprised from PDC.

21 Claims, 12 Drawing Sheets

(56) References Cited

U.S. PATENT DOCUMENTS 2,210,824 A * 8/1940 Walker, Sr. ..... E21B 10/26 175/406
2,380,112 A 7/1945 Kinnear
RE23,416 E 10/1951 Kinnear
2,634,955 A * 4/1953 Johnson ..... 175/350
2,651,501 A * 9/1953 McMahon ..... 175/365
2,742,439 A 4/1956 Hallett
2,901,223 A 8/1959 Scott
2,915,291 A 12/1959 Gulfelt
3,743,037 A 7/1973 Bulakh et al.
3,923,109 A * 12/1975 Williams, Jr. ..... 175/340
3,945,447 A 3/1976 Peterson
4,006,788 A 2/1977 Garner
4,127,043 A 11/1978 Evans
4,136,586 A 1/1979 Neilson et al.
4,145,094 A 3/1979 Vezirian
4,158,973 A 6/1979 Schumacher et al.
4,176,724 A 12/1979 Vezirian
4,187,743 A 2/1980 Thomas
4,204,437 A 5/1980 Espana
4,209,890 A 7/1980 Koskie
4,241,798 A * 12/1980 Jones ..... E21B 10/54 175/331
4,333,364 A 6/1982 Varel
4,339,009 A * 7/1982 Busby ..... E21B 10/52 175/374
4,350,060 A 9/1982 Vezirian
4,417,629 A 11/1983 Wallace
4,446,935 A * 5/1984 Schumacher, Jr. ..... 175/338
4,453,836 A 6/1984 Klima
4,496,013 A 1/1985 Serpa
4,549,614 A 10/1985 Kaalstad et al.
4,610,317 A * 9/1986 England et al. ..... 175/331
4,641,976 A 2/1987 Kar
4,694,551 A 9/1987 Mathews
4,751,972 A 6/1988 Jones et al.
4,763,736 A 8/1988 Varel
4,765,205 A 8/1988 Higdon
4,796,713 A * 1/1989 Bechem et al. ..... 175/96
4,819,517 A 4/1989 Vezirian
4,832,143 A 5/1989 Kaalstad et al.
4,874,047 A 10/1989 Hixon
4,924,954 A 5/1990 Mead
4,942,930 A 7/1990 Millsapps
4,953,641 A 9/1990 Pessier
5,027,911 A 7/1991 Dysart
5,064,007 A 11/1991 Kaalstad
5,147,000 A 9/1992 Kaalstad
5,189,932 A 3/1993 Palmo et al.
5,201,795 A 4/1993 Howard et al.
5,341,890 A * 8/1994 Cawthorne ..... E21B 10/5673 175/374
5,358,061 A 10/1994 Van Nguyen
5,439,068 A 8/1995 Huffstutler et al.
5,441,120 A 8/1995 Dysart
5,452,770 A 9/1995 Millsapps
5,505,273 A 4/1996 Azar et al.
5,524,510 A 6/1996 Davies et al.
5,586,612 A 12/1996 Isbell et al.
5,592,996 A 1/1997 Keith et al.
5,598,895 A 2/1997 Anderson et al.
5,606,895 A 3/1997 Huffstutler
5,636,700 A 6/1997 Shamburger, Jr.
5,641,029 A 6/1997 Beaton et al.
5,695,018 A 12/1997 Pessier et al.
5,695,019 A 12/1997 Shamburger, Jr.
5,839,525 A 11/1998 Hoffmaster et al.
5,887,580 A * 3/1999 Eyre ..... 125/36
5,944,125 A 8/1999 Byrd
5,975,223 A 11/1999 Karlsson
6,033,117 A 3/2000 Cariveau et al.
6,068,072 A * 5/2000 Besson ..... E21B 10/573 175/432
6,099,209 A * 8/2000 Murray ..... B23B 27/145 407/1
6,253,864 B1 * 7/2001 Hall ..... E21B 10/36 175/414
6,254,275 B1 7/2001 Slaughter, Jr. et al.
6,296,067 B1 10/2001 Slaughter, Jr. et al.
6,321,858 B1 11/2001 Wentworth et al.
6,345,673 B1 2/2002 Siracki
6,439,326 B1 8/2002 Huang et al.
6,450,271 B1 9/2002 Tibbitts et al.
6,516,293 B1 2/2003 Huang et al.
6,533,050 B2 * 3/2003 Molloy ..... 175/351
6,543,312 B2 4/2003 Sullivan
6,561,292 B1 5/2003 Portwood
6,568,490 B1 5/2003 Tso et al.
6,763,902 B2 7/2004 Larsen et al.
6,779,613 B2 8/2004 Dykstra et al.
6,810,971 B1 11/2004 Sved
6,827,159 B2 12/2004 Sved
6,883,624 B2 * 4/2005 McDonough ..... E21B 10/52 175/335
6,904,983 B2 * 6/2005 Thigpen ..... E21B 10/5673 175/428
6,935,443 B2 8/2005 Ehler et al.
7,195,085 B2 3/2007 Pia
7,341,119 B2 3/2008 Singh et al.
7,464,773 B2 12/2008 Rives
7,549,490 B2 6/2009 McDonough et al.
8,047,307 B2 11/2011 Pessier et al.
8,056,651 B2 11/2011 Turner et al.
8,141,664 B2 3/2012 Zahradnik et al.
8,672,060 B2 3/2014 Centala et al.
8,955,413 B2 2/2015 Bijai et al.
2001/0054514 A1 12/2001 Sullivan et al.
2002/0000336 A1 1/2002 Claesson et al.
2002/0029909 A1 3/2002 Griffo et al.
2002/0084112 A1 * 7/2002 Hall ..... E21B 10/5673 175/426
2006/0054361 A1 3/2006 Boudrare et al.
2007/0062736 A1 3/2007 Cariveau et al.
2007/0131457 A1 6/2007 McDonough et al.
2007/0221417 A1 9/2007 Hall et al.
2008/0011519 A1 1/2008 Smith et al.
2009/0057030 A1 3/2009 Didericksen et al.
2009/0272582 A1 11/2009 McCormick et al.
2010/0163313 A1 7/2010 Lin et al.
2010/0224417 A1 9/2010 Zahradnik et al.
2010/0270085 A1 10/2010 Turner et al.
2011/0023663 A1 2/2011 Bijai et al.
2011/0024197 A1 * 2/2011 Centala et al. ..... 175/353
2011/0162893 A1 7/2011 Zhang
2012/0031671 A1 2/2012 Propes
2012/0080230 A1 4/2012 Flores et al.
2014/0196956 A1 7/2014 Centala et al.
2014/0202773 A1 7/2014 Zhang et al.
2015/0090501 A1 4/2015 King

FOREIGN PATENT DOCUMENTS

GB 2203470 A 10/1988
GB 2384503 A 7/2003
WO 2008124572 A1 10/2008
WO 2011014590 A3 4/2011
WO 2011014591 A3 4/2011
WO 2011084944 A3 10/2011

OTHER PUBLICATIONS

Placido, et al. "The Disk Bit-A Tool for Hard-Rock Drilling", Dec. 2004, SPE Drilling and Completion, SPE 79798, pp. 205-211.
Office Action issued in related U.S. Appl. No. 12/844,589 on Jan. 4, 2013, 23 pages.
International Search Report and Written Opinion issued in related PCT application PCT/US2010/043603 on Mar. 2, 2011, 8 pages.
International Search Report and Written Opinion issued in related PCT application PCT/US2010/043604 dated Mar. 3, 2011, 6 pages.

(56) References Cited

OTHER PUBLICATIONS

International Search Report and Written Opinion issued in related PCT application PCT/US2011/020091 on Jun. 23, 2011, 6 pages.

* cited by examiner

HYBRID DISC BIT WITH OPTIMIZED PDC CUTTER PLACEMENT

BACKGROUND OF INVENTION

Disc drill bits are one type of drill bit used in earth drilling applications, particularly in petroleum or mining operations. In such operations, the cost of drilling is significantly affected by the rate the disc drill bit penetrates the various types of subterranean formations. That rate is referred to as rate of penetration ("ROP"), and is typically measured in feet or inches per hour. As a result, there is a continual effort to optimize the design of disc drill bits to more rapidly drill specific formations and reduce these drilling costs.

Disc drill bits are characterized by having disc-shaped cutter heads rotatably mounted on journals of a bit body. Each disc has an arrangement of cutting elements attached to the outer profile of the disc. Disc drill bits can have three discs, two discs, or even one disc. An example of a three disc drill bit 101, shown in FIG. 1A, is disclosed in U.S. Pat. No. 5,064,007 issued to Kaalstad ("the '007 Patent"), and. incorporated herein by reference in its entirety. Disc drill bit 101 includes a bit body 103 and three discs 105 rotatably mounted on journals (not shown) of bit body 103. Discs 105 are positioned to drill a generally circular borehole 151 in the earth formation being penetrated. Inserts 107 are arranged on the outside radius of discs 105 such that inserts 107 are the main elements cutting borehole 151. Furthermore, disc drill bit 101 includes a threaded pin member 109 to connect with a threaded box member 111. This connection enables disc drill bit 101 to be threadably attached to a drill string 113.

In this patent, inserts 107 on discs 105 are conically shaped and used to primarily generate failures by crushing the earth formation to cut out wellbore 151. During drilling, a force (referred to as weight on bit ("WOB")) is applied to disc drill bit 101 to push it into the earth formation. The WOB is translated through inserts 107 to generate compressive failures in the earth formation. In addition, as drill string 113 is rotated in one direction, as indicated by arrow 131, bit body 103 rotates in the same direction 133 as drill string 113, which causes discs 105 to rotate in an opposite direction 135.

Referring now to FIG. 1B, another type of disc drill bit, as disclosed in U.S. Pat. No. 5,147,000 also issued to Kaalstad ("the '000 Patent") incorporated herein by reference in its entirety, is shown. The '000 Patent discloses a similar three disc drill bit to that of the '007 Patent, but instead shows another arrangement of the inserts on the discs of the disc drill bit. In FIG. 1B, inserts 123 are disposed on the face of discs 125, instead of on the outside radius. The primary function of inserts 123 is to cut out the borehole by generating compressive failures from WOB. After inserts 123 generate the primary compressive failures, they then perform a secondary function of excavating the compressively failed earth. The conical shape and location of inserts 123 on disc drill bit 121 are effective for generating compressive failures, but are inadequate in shape and location to excavate the earth formation also. When used to excavate the earth formation from the compressive failures, inserts 123 wear and delaminate very quickly.

Although disc bits have been used successfully in the prior art, further improvements in the drilling performance may be obtained by improved cutting configurations.

SUMMARY OF THE INVENTION

In one aspect, the present invention relates to a drill bit. The drill bit includes a bit body and a journal depending from the bit body. The drill bit further includes a disc rotatably mounted on the journal and PDC cutting elements disposed on the disc.

In another aspect, the present invention relates to a cutting structure to be used with a disc drill bit. The cutting structure includes a shearing portion arranged in a shearing configuration, wherein the shearing portion comprises PDC. The cutting structure further includes a compressive portion arranged in a compressive configuration. The shearing portion and the compressive portion of the cutting structure are formed into a single body.

In another aspect, the present invention relates to a method of designing a drill bit, wherein the drill bit includes a bit body, a journal depending from the bit body, a disc rotatably mounted to the bit body, first radial row of cutting elements, and second radial of row cutting elements. The method includes identifying a relative velocity of the drill bit, and determining a compressive configuration of the first radial row of cutting elements based on the relative velocity. The method further includes determining a shearing configuration of the second radial row cutting elements based on the relative velocity of the drill bit. Then, the first radial row cutting elements are arranged on the disc of the drill bit based on the compressive configuration, and the second radial row cutting elements are arranged on the disc of the drill bit based on the shearing configuration.

Other aspects and advantages of the invention will be apparent from the following description and the appended claims.

DETAILED DESCRIPTION

As used herein, "compressive configuration" refers to a cutting element that primarily generates failures by crushing the earth formation when drilling.

As used herein, "shearing configuration," refers to a cutting element that primarily generates failures by shearing the earth formation when drilling.

In one or more embodiments, the present invention relates to a disc drill bit having at least one disc and at least one cutting element disposed on the disc to be oriented in a either a compressive configuration or a shearing configuration. More particularly, the cutting element oriented in either configuration can be made of polycrystalline diamond compact ("PDC"). The compact is a polycrystalline mass of diamonds that are bonded together to form an integral, tough, high-strength mass. An example of a PDC cutter for drilling earth formation is disclosed in U.S. Pat. No. 5,505,273, and is incorporated herein by reference in its entirety.

Figure 2A:
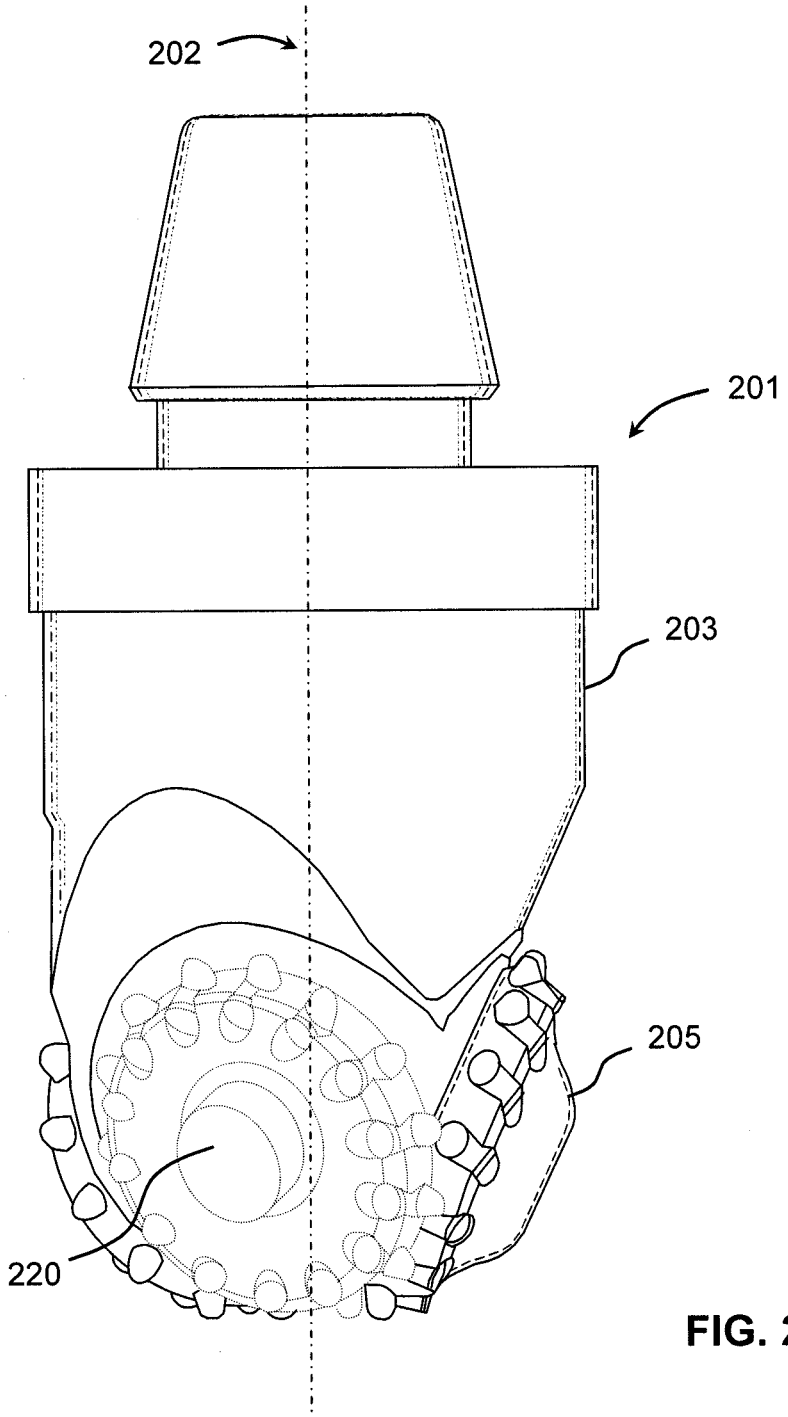
FIG. 2A shows an isometric view of a disc drill bit in accordance with an embodiment of the present invention.
Figure 2B:
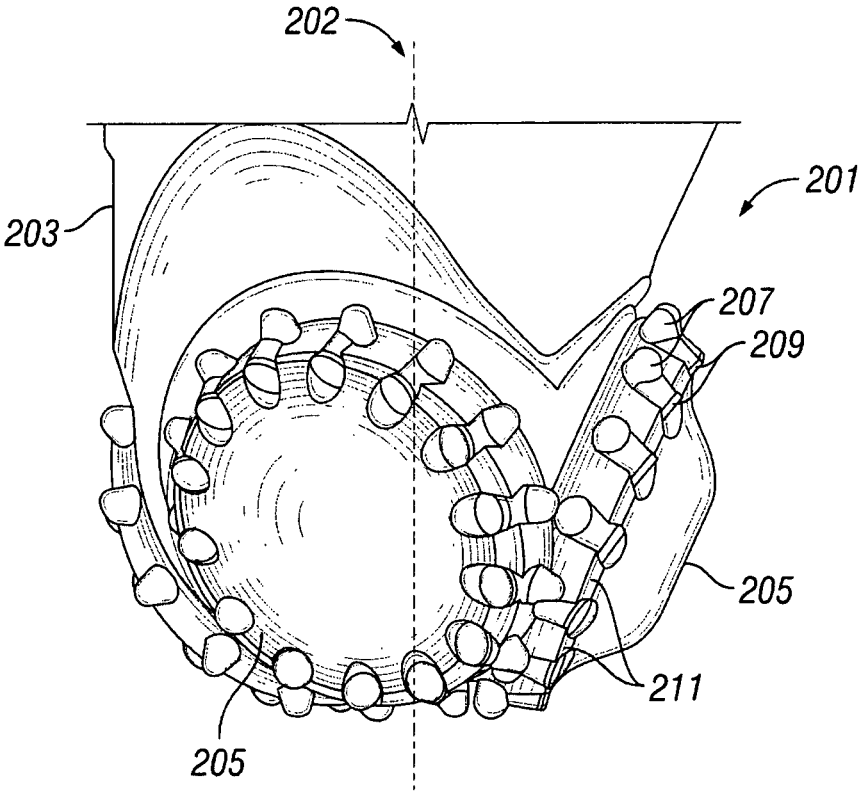
FIG. 2B shows an isometric view of the bottom of the disc drill bit of FIG. 2A.
Figure 7:
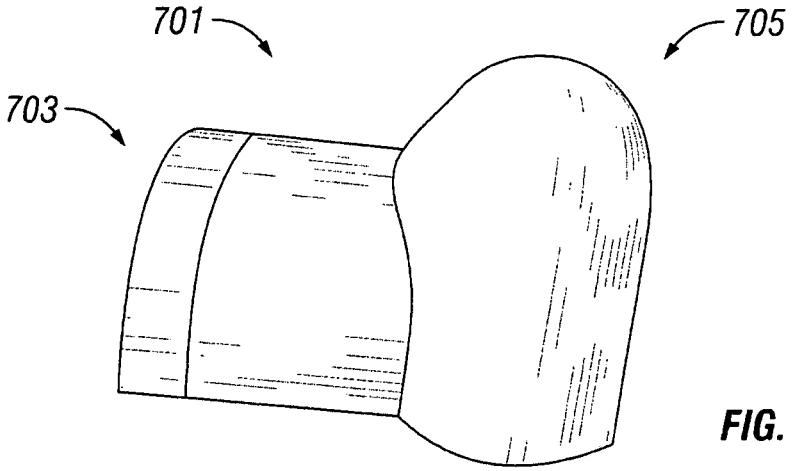
FIG. 7 shows an isometric view of a cutting structure in accordance with an embodiment of the present invention.

Referring now to FIG. 2A, a disc drill bit 201 in accordance with an embodiment of the present invention is shown. Disc drill bit 201 includes a bit body 203 having one or more journals 220, on which one or more discs 205 are rotatably mounted. Referring now to FIG. 2B, an enlarged view of disc drill bit 201 is shown. Disposed on at least one of discs 205 of disc drill bit 201 are a first radial row 207 of cutting elements and a second radial row 209 of cutting elements. First radial row 207 of cutting elements are located closer to an axis of rotation 202 of disc drill bit 201 than second radial row 209 of cutting elements. Thus, extending radially out from axis of rotation 202, first radial row 207 of cutting elements come before second radial row 207 of cutting elements. First radial row 207 of cutting elements and second radial row 209 of cutting elements act together to drill a borehole with a radius at which second radial row 209 of cutting elements extend from the axis of rotation of the disc drill bit. First radial row 207 of cutting elements penetrate into the earth formation to form the bottom of the borehole, and second radial row 209 of cutting elements shear away the earth formation to form the full diameter of the borehole. In this particular embodiment, each cutting element of second radial row 209 is configured into a single cutting structure 211 with a corresponding cutting element of first radial row 207. FIG. 7 shows a similar cutting structure to that of cutting structure 211. Cutting elements of first radial row 207 are arranged about the outside radius of discs 205 such that cutting elements of first radial row 207 are in a compressive configuration. Also, cutting elements of second radial row 209 are disposed on the face of discs 205 such that cutting elements of second radial row 209 are in a shearing configuration.

In some embodiments, cutting elements of the first radial row are oriented in the compressive configuration may be comprised of tungsten carbide, PDC, or other superhard materials, and may be diamond coated. Cutting elements of the first radial row are designed to compress and penetrate the earth formation, and may be of conical or chisel shape. The second radial row cutting elements have PDC as the cutting faces, which contact the earth formation to cut out the borehole. Also, cutting elements of the second radial row are oriented to shear across the earth formation.

Because the cutting elements of the first radial row on the discs of the disc drill bit are in a compressive configuration, the cutting elements primarily generate failures by crushing the earth formation when drilling. Additionally, because the cutting elements of the first radial row are more suited to compressively load the earth formation, significant shearing of the earth formation by the cutting elements of the first radial row should be avoided. Too much shearing may prematurely wear and delaminate the cutting elements of the first radial row. To arrange the cutting elements of the first radial row in a compressive configuration, the cutting elements should be oriented on the disc drill bit to have little or no relative velocity at the point of contact with respect to borehole. If the cutting elements of the first radial row have no relative velocity with the point of contact of the borehole, the cutting elements will generate compression upon the earth formation with minimal shearing occurring across the borehole.

Figure 8A:
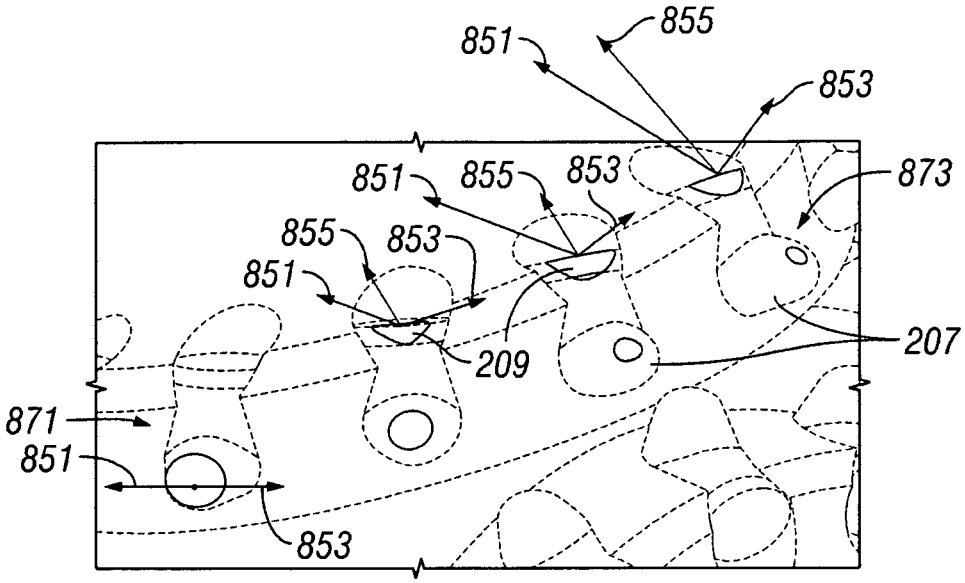
FIG. 8A shows a bottom view of a disc drill bit in accordance with an embodiment of the present invention.

Referring now to FIG. 8A, a relative velocity 855 of cutting elements of first radial row 207 and the components making up relative velocity 855 with respect to the borehole, is shown. Relative velocity 855 at the point of contact of cutting elements of first radial row 207 is made from two corresponding velocities. The first contributing velocity is bit body velocity 851, the velocity of the cutting element of first radial row 207 from the rotation of the bit body. Bit body velocity 851 is the product of rotational speed of the bit body, $\omega_{bit}$, and distance of the cutting element of the first radial row from the axis of rotation of the bit body, $R_{bit}$. The second contributing velocity is disc velocity 853, the velocity of the cutting element of first radial row 207 from the rotation of the discs. Disc velocity 853 is the product of rotational speed of the of the disc, $\omega_{disc}$, and distance of the cutting element of the first radial row from the axis of rotation of the disc, $R_{disc}$. Relative velocity 855, $V_{first\ radial\ row}$, is the sum of bit body velocity 851 and disc velocity 853, and is shown below:

$$V_{firstradialrow}=(\omega_{bit}\times R_{bit})+(\omega_{disc}\times R_{disc}) \quad \text{[Eq. 1]}$$

When the bit body is in one direction of rotation, the disc is put into an opposite direction of rotation. If such values are inserted into the formula then, either the value $\omega_{disc}$ or the value $\omega_{bit}$ would be negative. As cutting elements of first radial row 207 on the disc then passes through a contact point 871 with the borehole, the two corresponding velocity components, bit body velocity 851 and disc velocity 853, can be of equal magnitude and cancel out one another, resulting in a relative velocity of zero for $V_{first\ radial\ row}$. With little or no relative velocity then, the cutting elements of first radial row 207 located at contact point 871 would therefore generate almost entirely compressive loading upon the earth formation with minimal shearing occurring across the borehole. Thus, the cutting elements of the first radial row should be designed to contact and compress the borehole most at contact point 871. When the cutting elements of the first radial row can no longer maintain little or no relative velocity, they should disengage with the earth formation to minimize shearing action. With the determination of the direction of the relative velocity, the compressive configuration can be optimized to improve the compressive action of the cutting elements of the first radial row.

In contrast to cutting elements of first radial row 207, cutting elements of second radial row 209 are oriented to use the relative velocity to improve their shearing cutting efficiency. Referring still to FIG. 8A, a relative velocity 855 of cutting elements of second radial row 209 is made up of the same two corresponding velocities, bit body velocity 851 and disc velocity 853, as discussed above. Because cutting elements of first radial row 207 and cutting elements of second radial row 209 are located closely together, relative velocity 855 of cutting elements of first radial row 207 and cutting elements of second radial row 209 at points 871 and 873 are similar. Cutting efficiency of cutting elements of second radial row 209 improves if the shear cutting action occurs in the direction of relative velocity 855. Contact point 873 shows relative velocity 855 of cutting elements of second radial row 209. When cutting elements of second radial row 209 are oriented to shear in the direction of relative velocity 855, as shown, the shearing cutting efficiency is improved. With the determination of the direction of the relative velocity, the shearing configuration can be optimized to improve the shearing action of the cutting elements of the second radial row.

Figure 8B:
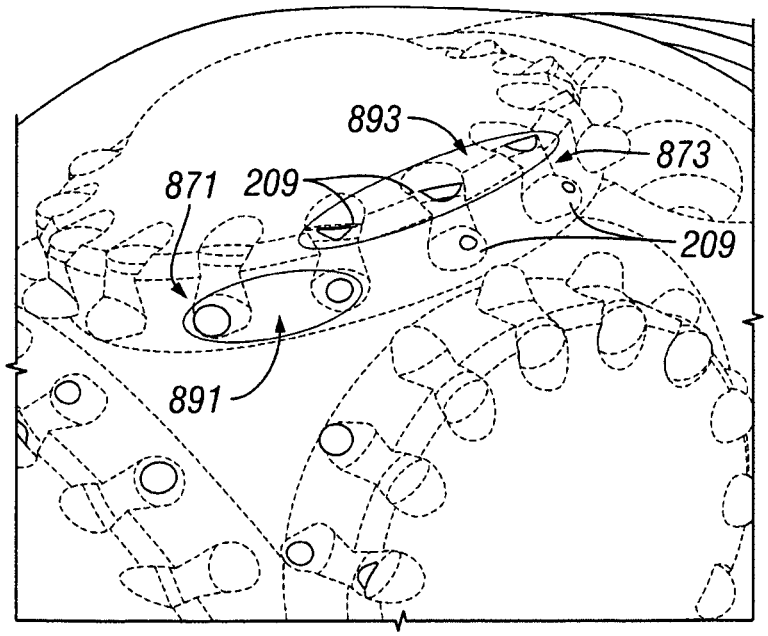
FIG. 8B shows a bottom view of the disc drill bit of FIG. 8A.

Referring now to FIG. 8B, another view of the embodiment of the present invention of FIG. 8A is shown. FIG. 8B depicts two zones 891, 893 of the cutting action from the disc drill bit. Compressive zone 891 is the zone which allows first radial row 207 of cutting elements to most effectively generate compressive failures. Contact point 871, which minimizes relative velocity of first radial row 207 of cutting elements, is located in the compressive zone 891. Shearing zone 893 is the zone which allows second radial row 209 of cutting elements to most efficiently generate shearing failures. Contact point 873, which has a high relative velocity for shearing of second radial row 209 of cutting elements, is located in shearing zone 893.

Figure 3A:
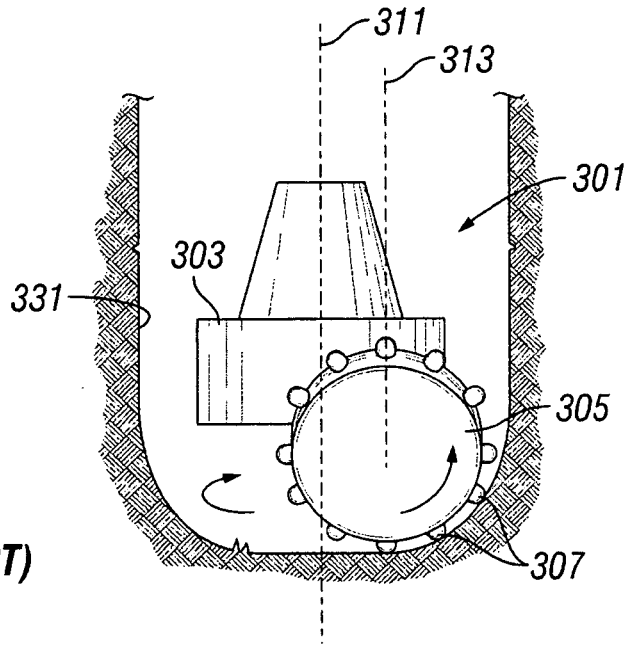
FIG. 3A (PRIOR ART)
FIG. 3A shows a schematic view of a prior art disc drill bit.
Figure 3B:
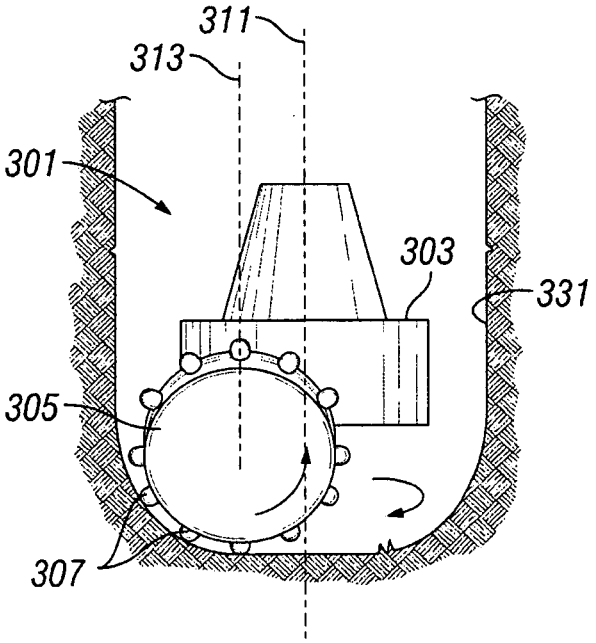
FIG. 3B (PRIOR ART)
FIG. 3B shows a schematic view of a prior art disc drill bit.

In one or more embodiments of the present invention, the discs in the disc drill bit may be positively or negatively offset from the bit body. Referring now to FIGS. 3A & 3B, examples of negative and positive offset in a prior art disc drill bit 301 are shown. Disc drill bit 301 includes a bit body 303 having a journal (not shown), on which a disc 305 is rotatably mounted. Inserts 307 are arranged on the outside radius of disc 305. Disc drill bit 301 further includes a center axis 311 of rotation of bit body 303 offset from an axis 313 of rotation of disc 305. Bit body 303 rotates in one direction, as indicated in the figures, causing disc 305 to rotate in an opposite direction when cutting a borehole 331. Referring specifically to FIG. 3A, axis 313 of rotation of disc 305 is offset laterally backwards in relation to the clockwise rotation of bit body 303, showing disc drill bit 301 as negatively offset. Referring specifically to FIG. 3B, axis 313 of rotation of disc 305 is offset laterally forwards in relation to the clockwise rotation of bit body 303, showing disc drill bit 301 as positively offset.

The positive and negative offset of the discs ensures that only an appropriate portion of the PDC cutting elements and inserts are cutting the borehole at any given time. If -the entire surface of the disc was effectively drilling the borehole, the discs and drill would be prone to stalling in rotation. The offset arrangement of the discs assures that only a selected portion of the disc is cutting. Also, offsets force the discs to shear while penetrating the earth formation. The present invention is particularly well adapted to be used with negative offset.

Figure 5:
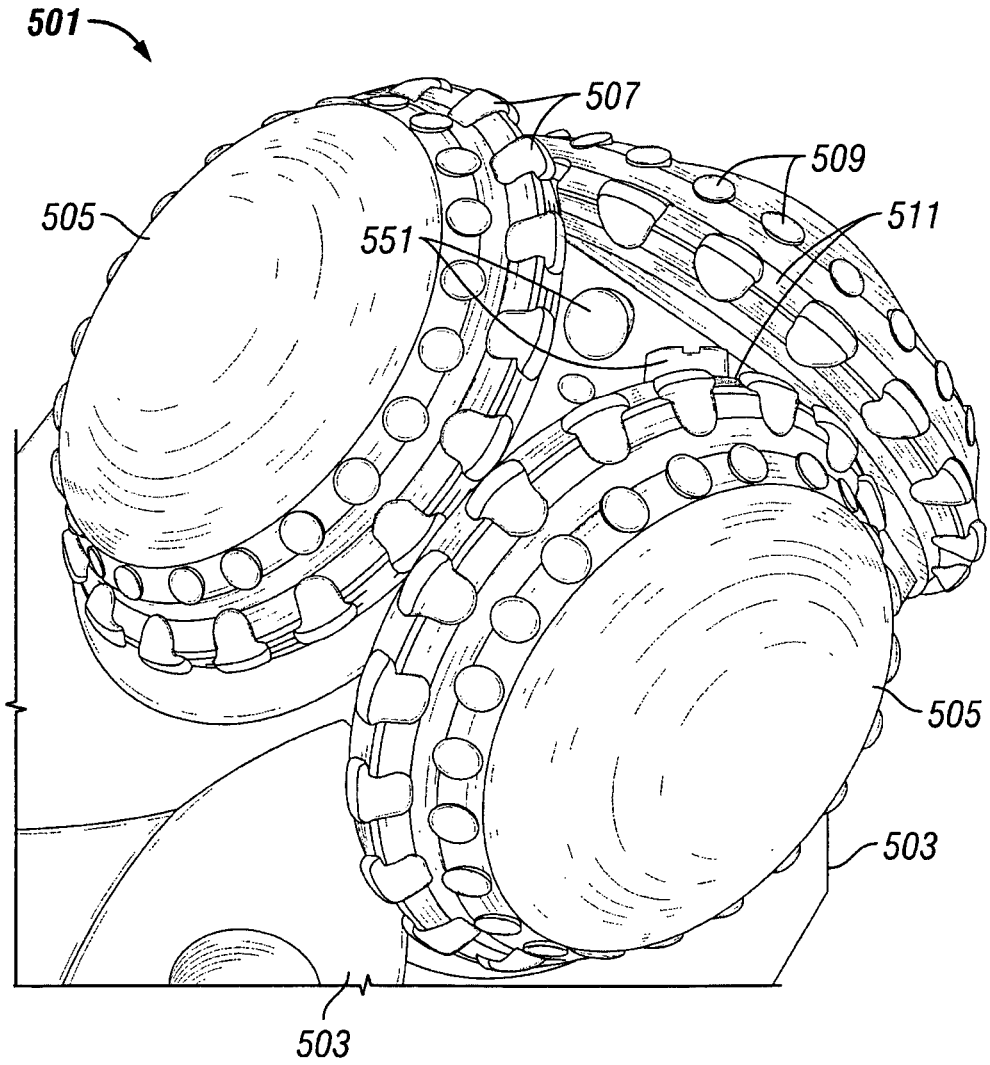
FIG. 5 shows a bottom view of a disc drill bit in accordance with an embodiment of the present invention.

Referring now to FIG. 5, another disc drill bit 501 in accordance with an embodiment of the present invention is shown. Disc drill bit 501 includes a bit body 503 having one or more journals (not shown), on which one or more discs 505 are rotatably mounted. Disposed on at least one of discs 505 of disc drill bit 501 are first radial row 507 of cutting elements and second radial row 509 of cutting elements. In this embodiment, cutting elements of second radial row 509 are not configured into individual cutting structures with cutting elements of first radial row 507 and are instead maintained as separate bodies. Cutting elements of first radial row 507 are arranged about the outside radius of discs 505 in a compressive configuration. Cutting elements of second radial row 509 are disposed on the face of disc 505 in a shearing configuration. As shown in FIG. 5, first radial row 507 of cutting elements form a row arranged radially outboard (away from the center of the disc) of the radial position of a row formed by second radial row 509 of cutting elements.

Disc drill bit 501 further includes a webbing 511 disposed on discs 505. Webbing 511 is arranged on the outside radius of discs 505 and is adjacent to first radial row cutting 507 of cutting elements. Optionally, webbing 511 can be an integral part of discs 505, as shown in FIG. 5, wherein webbing 511 is manufactured into discs 505. However, webbing 511 can also be an overlay that is placed on discs 505 after they have been manufactured. Furthermore, discs 505 could be manufactured, webbing 511 then placed on discs 505 adjacent to first radial row 507 of cutting elements, and webbing 511 then brazed onto discs 505 if necessary.

When drilling earth formations, webbing 511 can provide structural support for first radial row 507 of cutting elements to help prevent overloading. The compressive forces distributed on the cutting elements of first radial row 507 could be translated to webbing 511 for support. The height of webbing 511 can be adjusted such that the depth of cut of the cutting elements of first radial row 507 is limited. Having a low webbing height would allow the cutting elements of first radial row 507 to take a deeper cut when drilling into the earth formation, as compared to the depth of cut a high webbing height would allow. The adjustable webbing height further prevents overloading of the first radial row 509 of cutting elements.

Figure 1A:
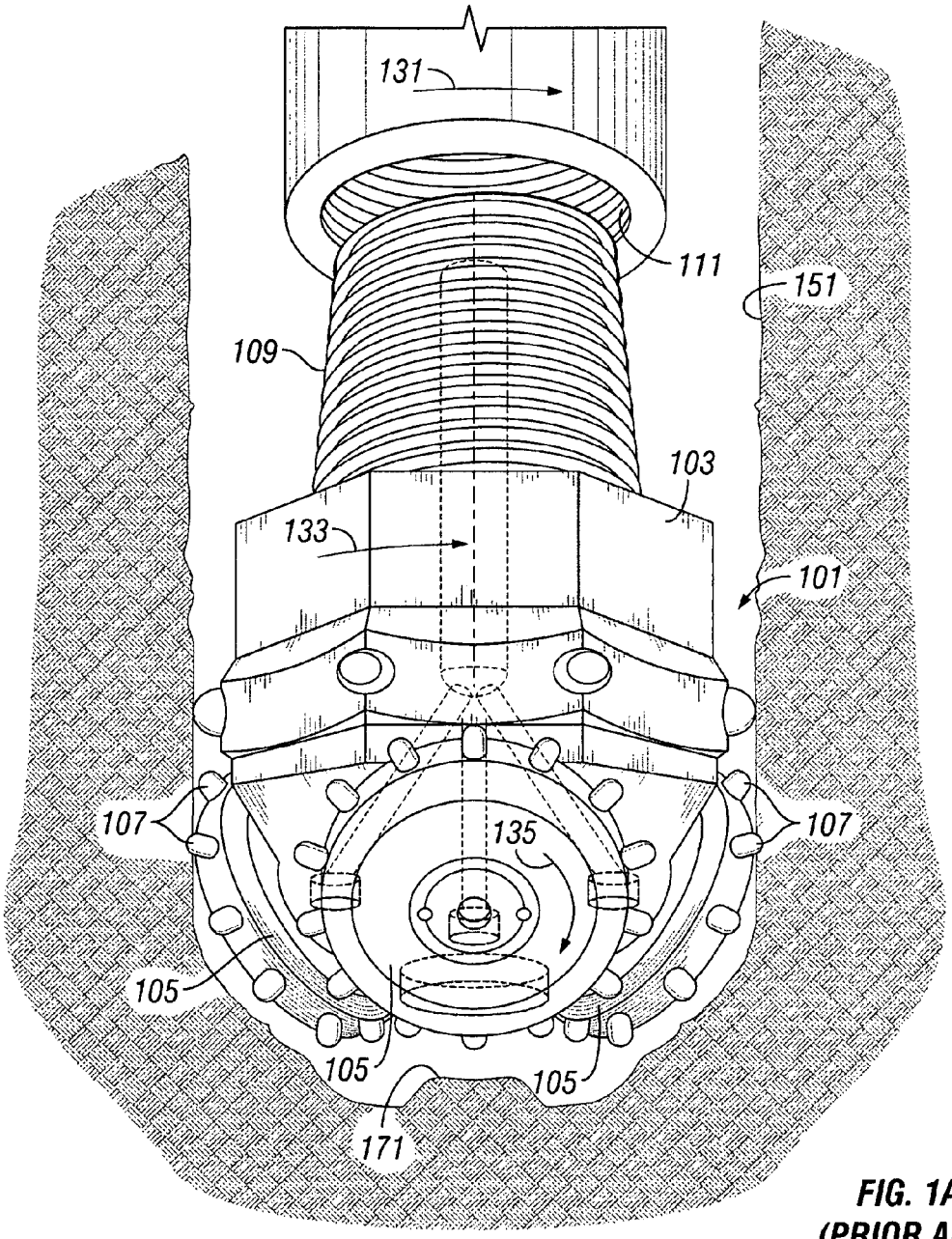
FIG. 1A (PRIOR ART)
FIG. 1A shows an isometric view of a prior art three disc drill bit.
Figure 1B:
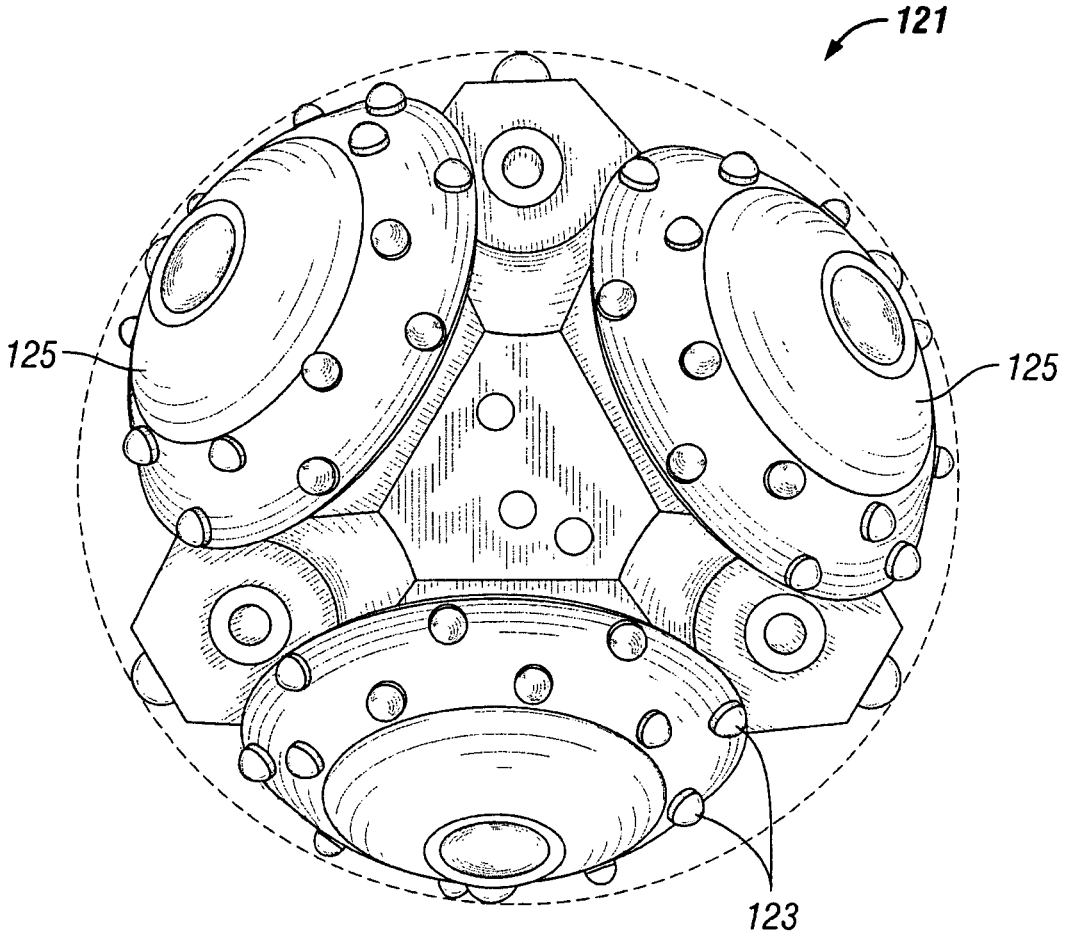
FIG. 1B (PRIOR ART)
FIG. 1B shows a bottom view of a prior art three disc drill bit.
Figure 6:
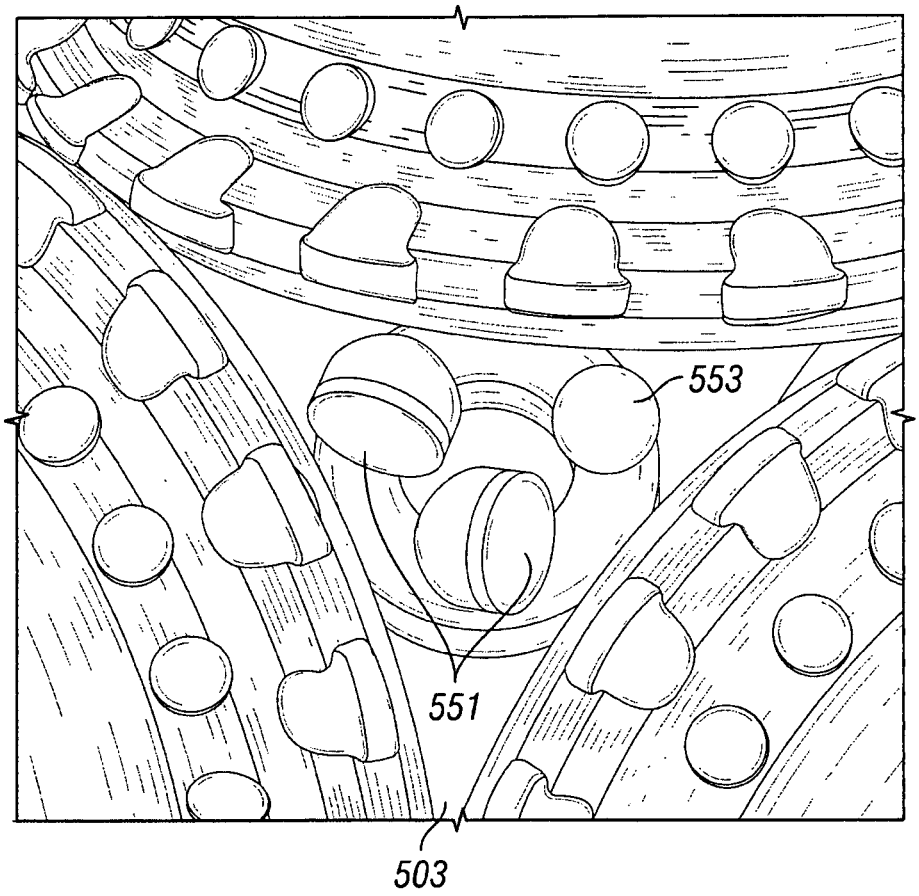
FIG. 6 shows a bottom view of the disc drill bit of FIG. 5.

Furthermore, FIG. 5 shows PDC cutting elements 551 located on the bottom of bit body 503 of disc drill bit 501. Referring now to FIG. 6, an enlarged view of the arrangement of PDC cutting elements 551 is shown. As discs 505 of disc drill bit 501 cut out a borehole in the earth formation, a bottom uncut portion may form at the bottom of the borehole that is not covered by the cutting surface of discs 505. Bottom uncut portion 171 is shown in FIG. 1. As disc drill bit 501 drills into the earth formation, PDC cutting elements 551 may be used to cut out the bottom of the borehole. FIG. 6 also shows a nozzle 553, which is located on the bottom of bit body 503. Nozzle 553 provides circulation of drilling fluid under pressure to disc drill bit 501 to flush out drilled earth and cuttings in the borehole and cool the discs during drilling.

Embodiments of the present invention do not have to include the features of the webbing arranged on the discs and the single cutting structure formed from the first and second radial row cutting elements. Embodiments are shown with the webbing alone, and embodiments are shown with the single cutting structure alone. However, other embodiments can be created to incorporate both the webbing and the single cutting structure or exclude both the webbing and the single cutting structure. Those having ordinary skill in the art will appreciate that the present invention is not limited to embodiments which incorporate the webbing and the single cutting structure.

Figure 9A:
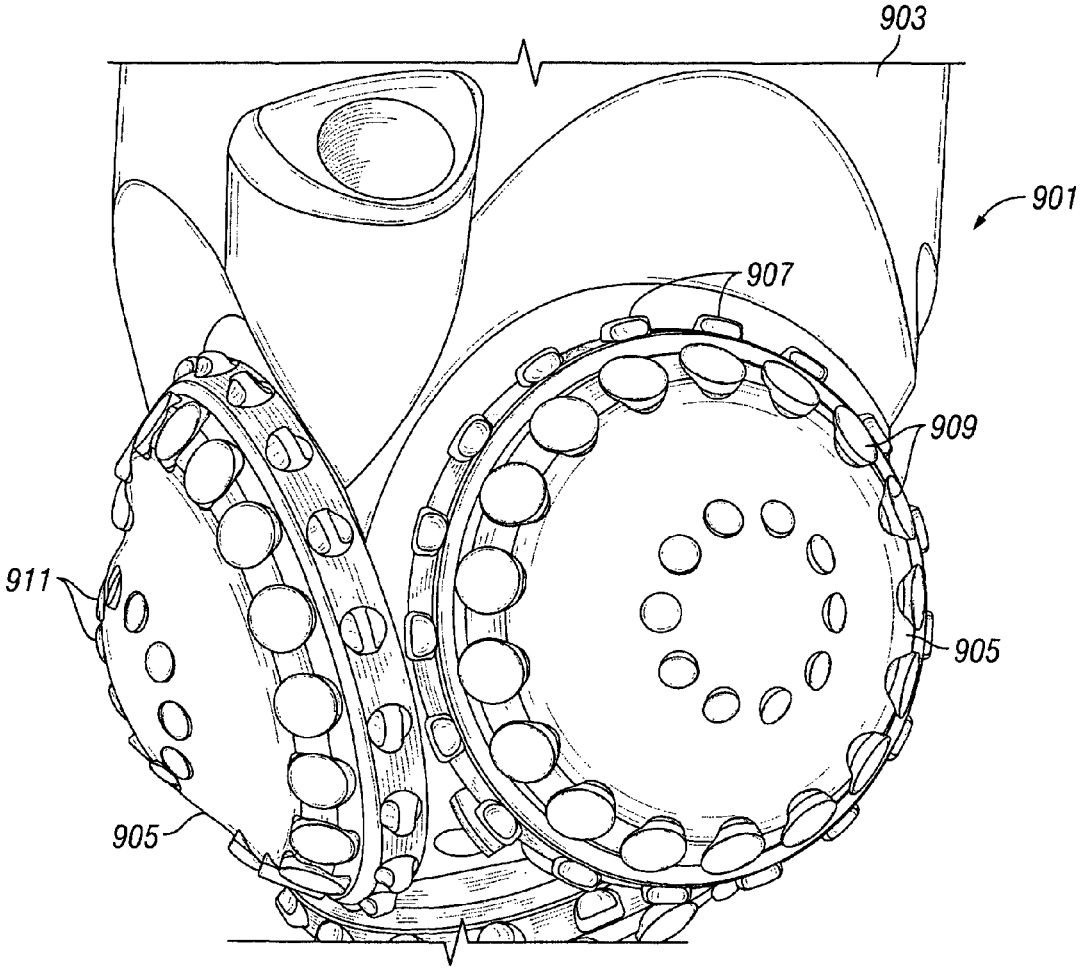
FIG. 9A shows an isometric view of a disc drill bit in accordance with an embodiment of the present invention.

Further, those having ordinary skill in the art will appreciate that the present invention is not limited to embodiments which incorporate only two rows of cutting elements. Other embodiments may be designed which have more than two rows of cutting elements. Referring now to FIG. 9A, another disc drill bit 901 in accordance with an embodiment of the present invention is shown. Disc drill bit 901 includes a bit body 903 having one or more journals (not shown), on which one or more discs 905 are rotatably mounted. Disposed on at least one of discs 905 of disc drill bit 901 are first radial row 907 of cutting elements, second radial row 909 of cutting elements, and third radial row 911 of cutting elements. Cutting elements of first radial row 907 are located closest to the axis of rotation of disc drill bit 901, followed by the cutting elements of second radial row 909, and then the cutting elements of third radial row 911. The cutting elements of first radial row 907, second radial row 909, and third radial row 911 act together to drill a borehole with a radius at which the cutting elements of third radial row 911 extend from the axis of rotation of the disc drill bit. Cutting elements of first radial row 907 penetrate into the earth formation to form the bottom of the borehole, the cutting elements of second radial row 909 shear the earth formation to form the sides of the borehole, and the cutting elements of third radial row 911 ream and polish the earth formation to form the full diameter of the borehole. Cutting elements of third radial row 911 enlarge the borehole to a radius at which the third radial row 911 of cutting elements extend from the axis of rotation of disc drill bit 901.

Referring still to FIG. 9A, first radial row 907 of cutting elements are arranged about the outside radius of discs 905 such that its cutting elements are in a compressive configuration. Second radial row 909 of cutting elements are disposed on the face of discs 905 such that its cutting elements are in a shearing configuration. The third radial row 911 of cutting elements are also disposed on the face of discs 905 of disc drill bit 901, but second radial row 909 of cutting elements are radially outboard (away from the center of the disc) of the radial position of third radial row 911 of cutting elements.

In some embodiments, the cutting elements of the first radial row are oriented in the compressive configuration and may be comprise tungsten carbide, PDC, or other superhard materials, and may be diamond coated. The cutting elements of the first radial row cutting elements are designed to compress and penetrate the earth formation, and may be of conical or chisel shape. Preferably, the cutting elements of the second radial row have PDC as the cutting faces, which contact the earth formation to cut out the borehole. The cutting elements of the second radial row may have a substantially planar cutting face formed of PDC and are oriented to shear across the earth formation. Similarly, the cutting elements of the third radial row have cutting faces which are comprised of PDC. The cutting elements of the third radial row shear across the earth formation to enlarge the borehole to full diameter.

Figure 4A:
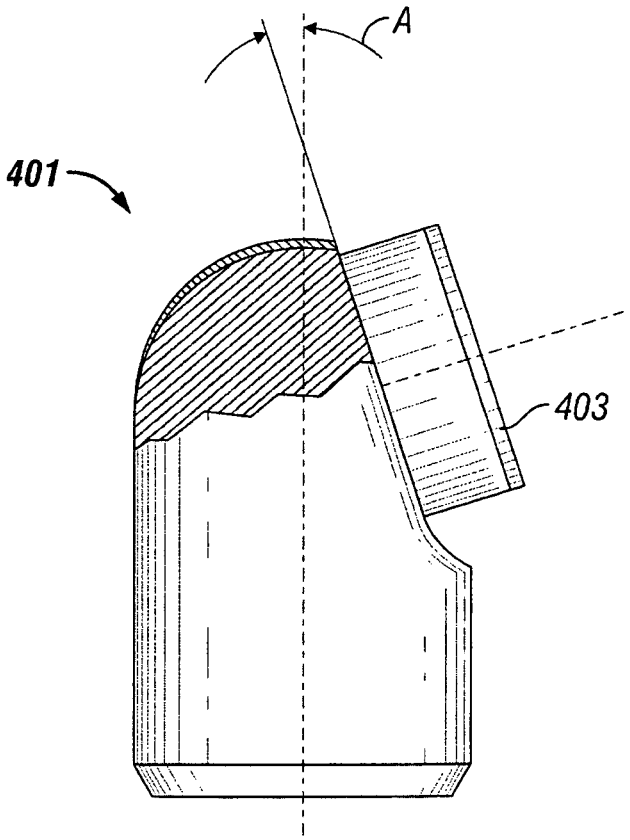
FIG. 4A (PRIOR ART)
FIG. 4A shows an isometric view of a prior art PDC bit.
Figure 9B:
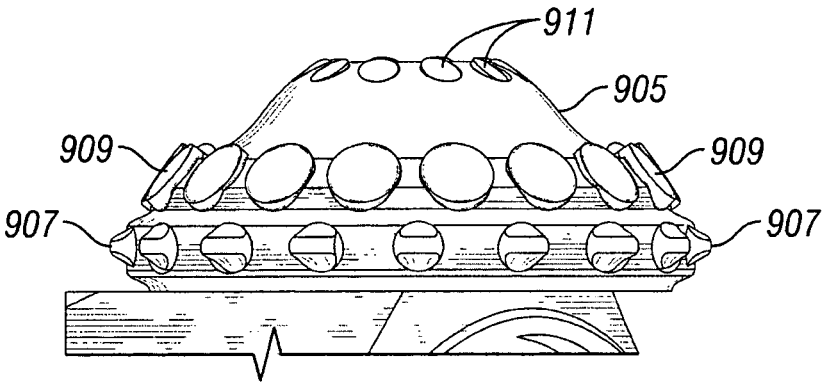
FIG. 9B shows an isometric view of the disc drill bit of FIG. 9A.
Figure 9C:
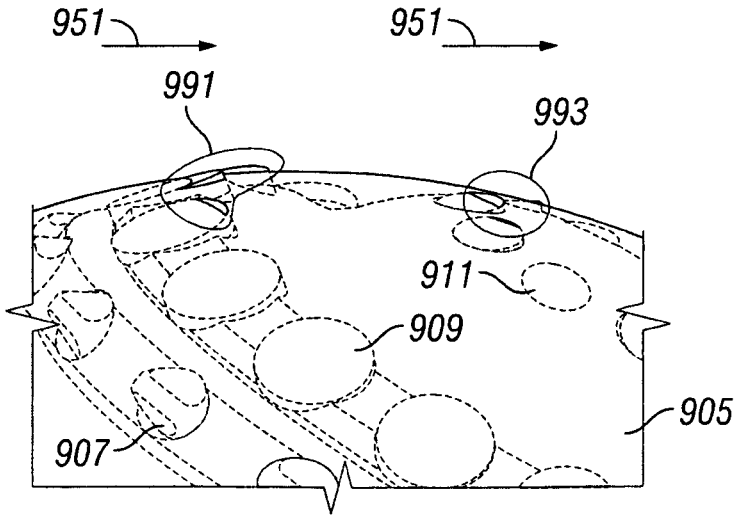
FIG. 9C shows an isometric view of the disc drill bit of FIGS. 9A and 9B.

In one or more embodiments of the present invention, to assist in the shearing action, the cutting elements of the second and third radial rows may be oriented with a negative or positive rake angle. Referring now to FIG. 4, an example of negative rake angle is shown in a prior art PDC cutter 401. PDC cutter 401 has a PDC cutter disc 403 rearwardly tilted in relation to the earth formation being drilled. A specific angle "A" refers to the negative rake angle the PDC cutter is oriented. Preferably, a rake angle from about 5 to 30 degrees of rake angle orientation is used. Similarly, a positive rake angle would refer to the PDC cutter disc forwardly tilted in relation to the earth formation being drilled. An effective rake angle would prevent delamination of the PDC cutting element. FIGS. 9B and 9C show an embodiment incorporating the use of one rake angle orientation, and FIGS. 10A and 10B show another embodiment incorporating the use of two rake angle orientations.

In FIG. 9B, the cutting elements of second radial row 909 and third radial row 911 are oriented with a positive rake angle to allow the sides of the cutting elements to perform the cutting action. As shown in FIG. 9C, when the cutting elements are moving in the direction 951, the sides (cylindrical edge) of the cutting elements shear across the borehole to generate failures in the earth formation. Therefore, the sides of the cutting elements are loaded with the predominant cutting forces. The shearing sides of the cutting elements are shown in zones 991 and 993.

Figure 10A:
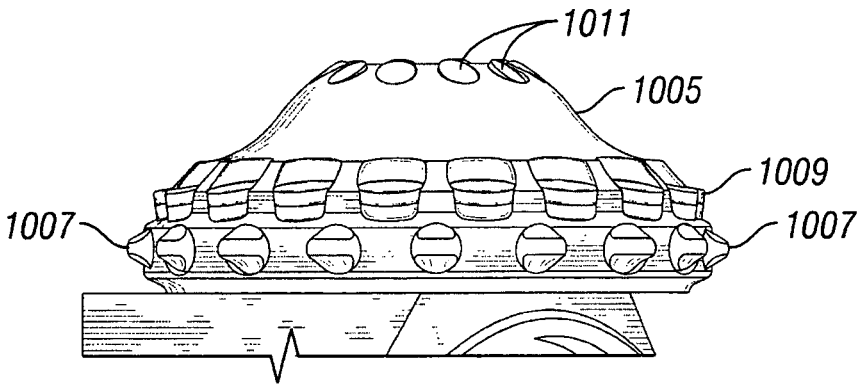
FIG. 10A shows an isometric view of a disc drill bit in accordance with an embodiment of the present invention.
Figure 10B:
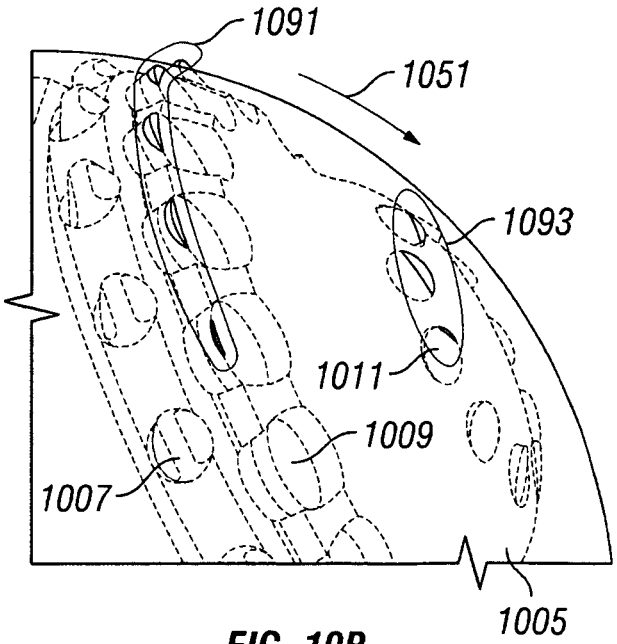
FIG. 10B shows an isometric view of the disc drill bit of FIG. 10A.

In FIG. 10A, the cutting elements of third radial row 1011 are oriented with a positive rake angle to allow the sides of the cutting elements to perform the shearing cutting action. However, the cutting elements of second radial row 1009 are oriented in a negative rake angle to instead the faces of the cutting elements to perform the shearing cutting action. Thus, with a negative rake angle, the faces of the cutting elements are loaded with the predominant cutting forces. Referring now to FIG. 10B, another view of the embodiment in FIG. 10A is shown. When the cutting elements are moving in the direction 1051 to maximize shearing, the cutting elements in zone 1093 are oriented in a positive rake angle to allow the sides of the cutting elements to shear across the borehole to generate failures in the earth formation, while the cutting elements in zone 1091 are oriented in a negative rake angle to allow the faces of the cutting elements to shear across the borehole. Both rake angle orientations can be used for the cutting elements of embodiments of the present invention. The rake angle orientation may be varied from disc to disc of the disc drill bit, or from radial row to radial row, or even from cutting element to cutting element. The rake angle orientation is not intended to be a limitation of the present invention.

Those having ordinary skill in the art will appreciate that other embodiments of the present invention may be designed with arrangements other than three discs rotatably mounted on the bit body. Other embodiments may be designed to incorporate only two discs, or even one disc. Also, embodiments may be designed to incorporate more than three discs. The number of discs on the disc drill bit is not intended to be a limitation of the present invention.

As seen in roller cone drill bits, two cone drill bits can provide a higher ROP than three cone drill bits for medium to hard earth formation drilling. This concept can also be applied to disc drill bits. Compared with three disc drill bits, two disc drill bits can provide a higher indent force. The "indent force" is the force distributed through each cutting element upon the earth formation. Because two disc drill bits can have a fewer amount of total cutting elements disposed on the discs than three disc drill bits, with the same WOB, two disc drill bits can then provide a higher indent force. With a higher indent force, two disc drill bits can then provide a higher ROP. Two disc drill bits can also allow larger cutting elements to be used on the discs, and provide more flexibility in the placement of the nozzles. Further, the discs on two disc drill bits can be offset a larger distance than the discs of three disc drill bits. In the event a two disc drill bit is designed, an angle from about 165 to 180 degrees is preferred to separate the discs on the disc drill bit.

Additionally, those having ordinary skill in the art that other embodiments of the present invention may be designed which incorporates discs of different sizes to be disposed on the disc drill bit. Embodiments may be designed to incorporate discs to be rotatably mounted to the disc drill bit, in which the discs vary in size or thickness in relation to each other. The size of the discs is not intended to be a limitation of the present invention.

Referring now to FIG. 7, a cutting structure 701 in accordance with another embodiment of the present invention is shown. Cutting structure 701 includes a compressive portion 705 and a shearing portion 703 formed into a single body. Shearing portion 703 of cutting structure 701 is comprised of PDC. Cutting structure 701 may be placed on a disc of a disc drill bit by being brazed onto the disc, or cutting structure 701 may be integrally formed into the discs when manufactured. Cutting structure 701 is then disposed on the disc such that shearing portion 703 is arranged in a shearing configuration to generate failures by shearing the earth formation when drilling and compressive portion 705 is arranged in a compressive configuration to generate failures by crushing the earth formation when drilling.

In the embodiments shown, compressive portion 705 of cutting structure 701 may be comprised of tungsten carbide, PDC, or other superhard materials, and may be diamond coated. Compressive portion 705, which may be of a conical or chisel shape, is designed to compress and penetrate the earth formation. Shearing portion 703 of cutting structure 701 has PDC as the cutting face which contacts the earth formation to cut out the borehole. Shearing portion 703 is designed to shear across the earth formation.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A drill bit comprising:
- a bit body;
- a journal extending at least downwardly from the bit body;
- a disc rotatably mounted on the journal; and
- a cutting structure disposed on the disc, the cutting structure comprising:
  - a shearing portion arranged in a shearing configuration, wherein the shearing portion comprises PDC; and
  - a compressive portion arranged in a compressive configuration;
  - wherein the shearing portion and the compressive portion form a single body.

2. The drill bit of claim 1, wherein the compressive portion is selected from the group consisting of tungsten carbide and PDC.

3. The drill bit of claim 1, wherein the compressive portion is diamond coated.

4. The drill bit of claim 1, wherein the shearing portion is spaced apart from the compressive portion.

5. The drill bit of claim 1, wherein an axis through the compressive portion is parallel to an axis through a face of the shearing portion.

6. The drill bit of claim 1, wherein the compressive portion is a different material than the shearing portion.

7. The drill bit of claim 1, wherein the compressive portion comprises a conical or chisel shape.

8. The drill bit of claim 1, wherein the shearing portion is oriented with a negative rake angle.

9. The drill bit of claim 8, wherein the negative rake angle is from about 5 to 30 degrees.

10. A method of designing a drill bit, the method comprising:
- identifying a relative velocity of the drill bit with respect to a borehole, wherein the drill bit comprises,
  - a bit body;
  - a journal depending from the bit body;
  - a disc rotatably mounted to the journal;
  - a first radial row of cutting elements; and
  - a second radial row of cutting elements comprised of PDC;
- determining a compressive configuration of the first radial row of cutting elements based on the relative velocity of the drill bit;
- determining a shearing configuration of the second radial row of cutting elements based on the relative velocity of the drill bit;
- arranging the first radial row of cutting elements on the disc based on the compressive configuration; and
- arranging the second radial row of cutting elements on the disc based on the shearing configuration.

11. The method of claim 10, wherein the first radial row of cutting elements and the second radial row of cutting elements of the drill bit are configured into a single structure.

12. The method of claim 10, wherein the drill bit further comprises a third radial row of cutting elements disposed on the disc.

13. A drill bit comprising:
- a bit body;
- a cutting structure fixed to the bit body, the cutting structure comprising:
  - a compressive portion arranged in a compressive configuration within a first radial row; and
  - a shearing portion arranged in a shearing configuration within a second radial row, the first radial row being radially closer than the second radial row to an axis of rotation of the bit body,
  - wherein the shearing portion and the compressive portion form a single body.

14. The drill bit of claim 13, wherein the shearing portion is arranged in a shearing configuration configured to generate failures by shearing formation.

15. The drill bit of claim 13, wherein the shearing portion comprises polycrystalline diamond.

16. The drill bit of claim 13, wherein the compressive portion is arranged in a compressive configuration configured to generate failures by crushing formation.

17. The drill bit of claim 13, wherein the compressive portion comprises a material selected from the group consisting of tungsten carbide and polycrystalline diamond.

18. The drill bit of claim 13, where in the compressive portion comprises a conical or chisel shape.

19. The drill bit of claim 13, wherein the shearing portion is oriented with a negative rake angle as measured relative to drilled formation.

20. The drill bit of claim 19, wherein the negative rake angle is from about 5 to 30 degrees.

21. The drill bit of claim 13, wherein the shearing portion is oriented with a positive rake angle as measured relative to drilled formation.

* * * * *